US007469502B1

(12) United States Patent
Steel

(10) Patent No.: US 7,469,502 B1
(45) Date of Patent: Dec. 30, 2008

(54) WINDOW SHUTTER SYSTEM

(76) Inventor: Jonathan Steel, 1781 Bayside Blvd., Jacksonville, FL (US) 32259

( * ) Notice: Subject to any disclaimer, the term of this patent is extended or adjusted under 35 U.S.C. 154(b) by 156 days.

(21) Appl. No.: 11/711,535

(22) Filed: Feb. 27, 2007

(51) Int. Cl.
*E05C 21/02* (2006.01)

(52) U.S. Cl. ..... 49/465; 49/463

(58) Field of Classification Search ..... 49/50, 49/57, 463, 465, 466, 55; 52/202, 203
See application file for complete search history.

(56) References Cited

U.S. PATENT DOCUMENTS 1,400,399 A * 12/1921 Yaeche ..... 49/465
3,000,063 A * 9/1961 Hoog ..... 49/317
5,457,921 A 10/1995 Kostrzecha
5,477,903 A 12/1995 Figueiredo et al.
5,651,221 A 7/1997 Golen
5,755,270 A 5/1998 Knezevich et al.
7,305,800 B1 * 12/2007 Calfee ..... 52/203

* cited by examiner

*Primary Examiner*—Jerry Redman
(74) *Attorney, Agent, or Firm*—Lawrence J. Gibney, Jr.

(57) ABSTRACT

This is a storm shutter device, which is lightweight, portable and easy to install and un-install. A series of protective panels will extend from the interior of the device to seal the area around the outside of the window. Appropriate tension will be maintained around the window frame through a series of interior gear teeth and a plurality of exterior adjustment knobs. A pawl in the interior of the device insures that the device will remain in place once the device is installed in the area around the window frame.

4 Claims, 13 Drawing Sheets

WINDOW SHUTTER SYSTEM

BACKGROUND OF THE INVENTION

A. Field of the Invention

This relates to the protection of a structure during periods of inclement weather, specifically the protector of windows. One danger during periods of inclement weather is the danger from flying objects as they impact a window. This can be devastating in terms of damage to the window itself as well as to the interior of the structure not to mention any individuals who happen to be in the building.

One of the traditional ways of protecting the windows and therefore protecting the interior is to insert plywood sheets or some other barrier device over the windows. A drawback to the installation of plywood specifically is that when the plywood becomes wet it will warp and, therefore, must be discarded after one use. Another problem with a plywood type structure is the difficulty installing the plywood because of its weight and relatively awkward size. This device is designed to be reusable, is easily installed and covers the entire window.

B. Prior Art

There are many other prior art references related to window shutter systems, some which require modification to the frame of the window and some which require installation of permanent devices on the outside structure of a house. In the current application the device allows the user to adjust the fit of the device to the window using a set of retractable panes of protective covers. Representation examples of this type of device in the prior art include Golen, U.S. Pat. No. 5,651,221, Knezevich, U.S. Pat. No. 5,755,270 and Figueiredo, U.S. Pat. No. 5,477,903. None of the prior art references, however, use the same means to retract the protective covers to fit any sized window.

There are many other types of window protection devices in the prior art but none use an internal set of gears to position the protective covers over the area of the window that is to be protected.

BRIEF SUMMARY OF THE INVENTION

In a storm, there is a danger of flying debris that may include tree limbs, twigs, and pinecones to name just a few examples. When a small article traveling at a great speed strikes a window, it may fracture the window and submit the occupants of the interior of the building to physical injury as well as damage to the actual physical structure of the building. This device is meant to cover the entire window structure and to be placed over the outside of the window. It will be portable and light weight enough so that most individuals can install it. It will have a quick release button so that it can be easily uninstalled.

One of the difficulties with similar storm protection devices is maintaining the appropriate tension along the exterior surface of the window frame to insure that the device remains in place particularly during periods of high winds. This needed feature is accomplished in this application by a unique rack-and-pinion system, using a set of interior gears and a pawl mechanism that allows the individual to tighten the device around the perimeter or to quickly release or disengage the device from the structure of the window. The edges of the vanes or members that make contact with the frame of the building are provided with seals to insure the appropriate amount of tension against the window frame structure.

A set of protective panels or vanes will cover all portions of the window. There are a set of members that cover the horizontal portion of the window and a different set to cover the vertical portion of the window. Additionally, the corners will also be covered by similar vanes.

In the interior of the device will be a gear that will allow an individual to tighten as much as possible this device onto the frame structure. A set of exterior knobs will allow the inner gear to be turned to achieve the appropriate tension against the building.

In order to make sure that the rack and pinion maintains its position a pawl will be used so that the pawl will make contact with the gear teeth. The pawl mechanism, which will take the general shape of a cam will lock onto an interior tooth to ensure that the device does not inadvertently disengage during normal operations.

A handle will allow the device to be carried easily and on the handle will be a button that will move the pawl mechanism from front to back, thereby retracting the protective panes. The shifting of the pawl will allow the gears to be moved and the vanes to be retracted. A spring in the push button mechanism moves the pawl from front to back in the interior of the device.

DETAILED DESCRIPTION OF THE EMBODIMENTS

Figure 1:
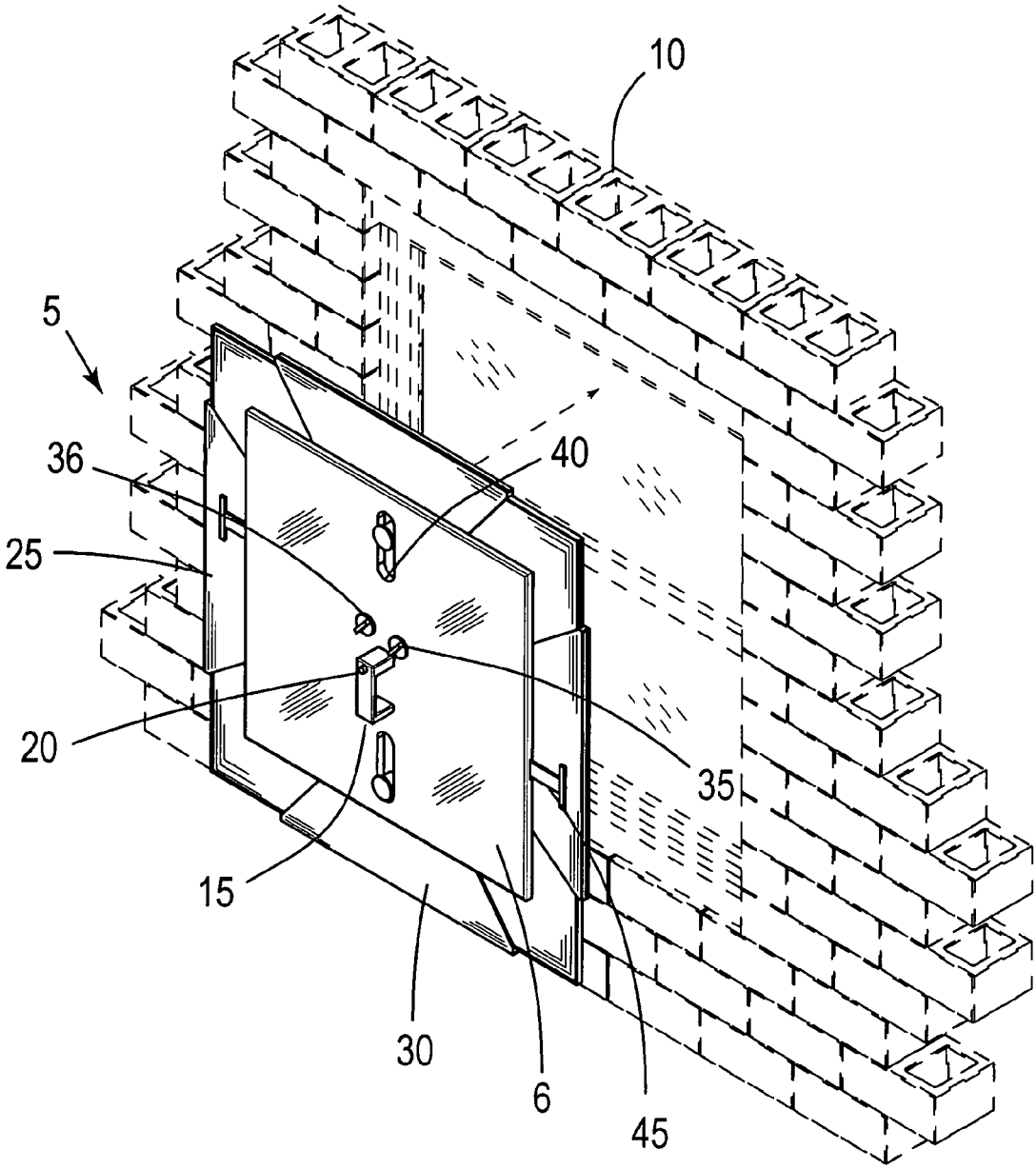
FIG. 1 is an isometric view of the device prior to being installed in the window.
Figure 2:
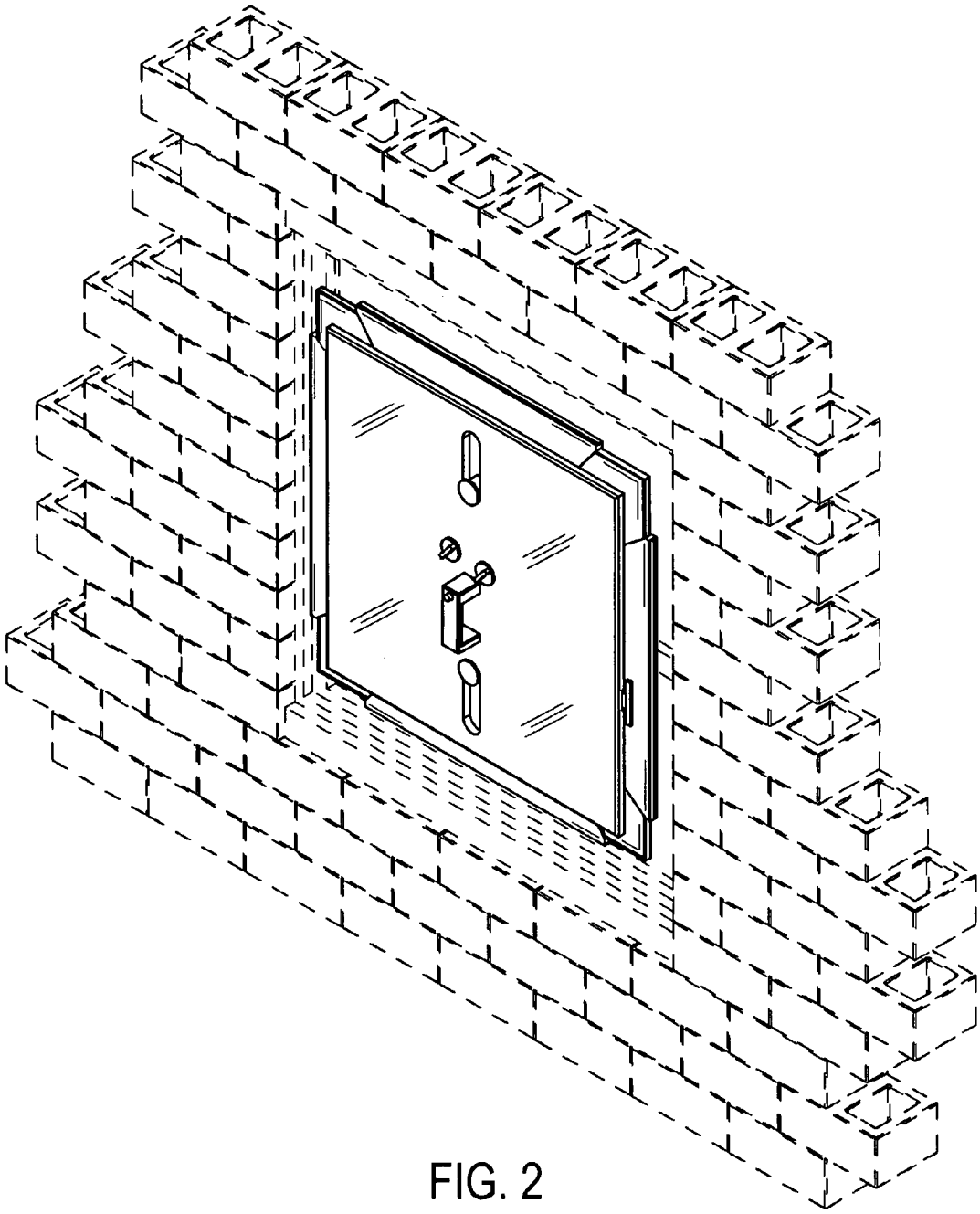
FIG. 2 is an isometric view of the device being installed within the perimeter of the window frame structures but not being engaged.
Figure 3:
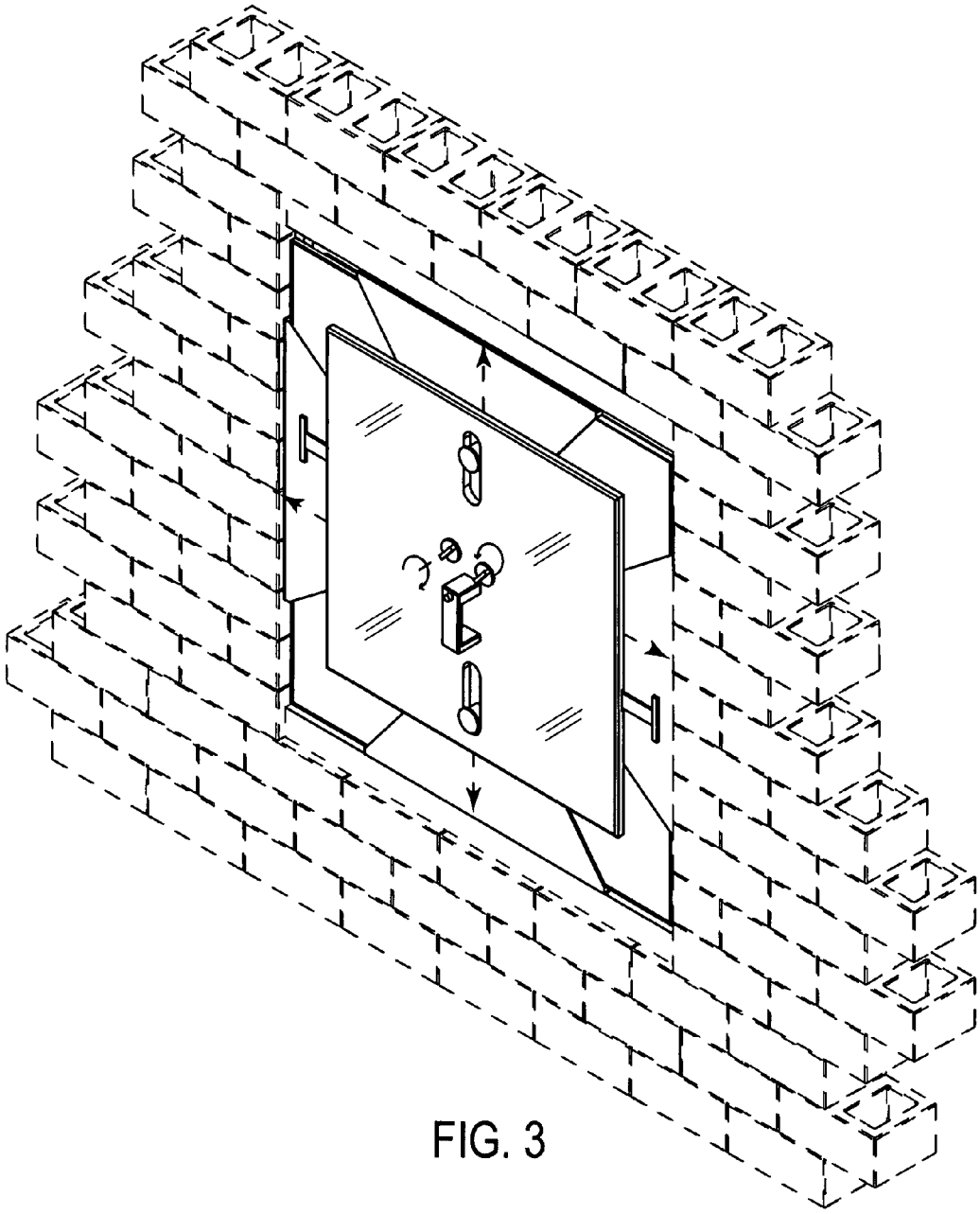
FIG. 3 is an isometric view of the device being installed within the perimeter of the window frame with the vanes deployed.
Figure 4:
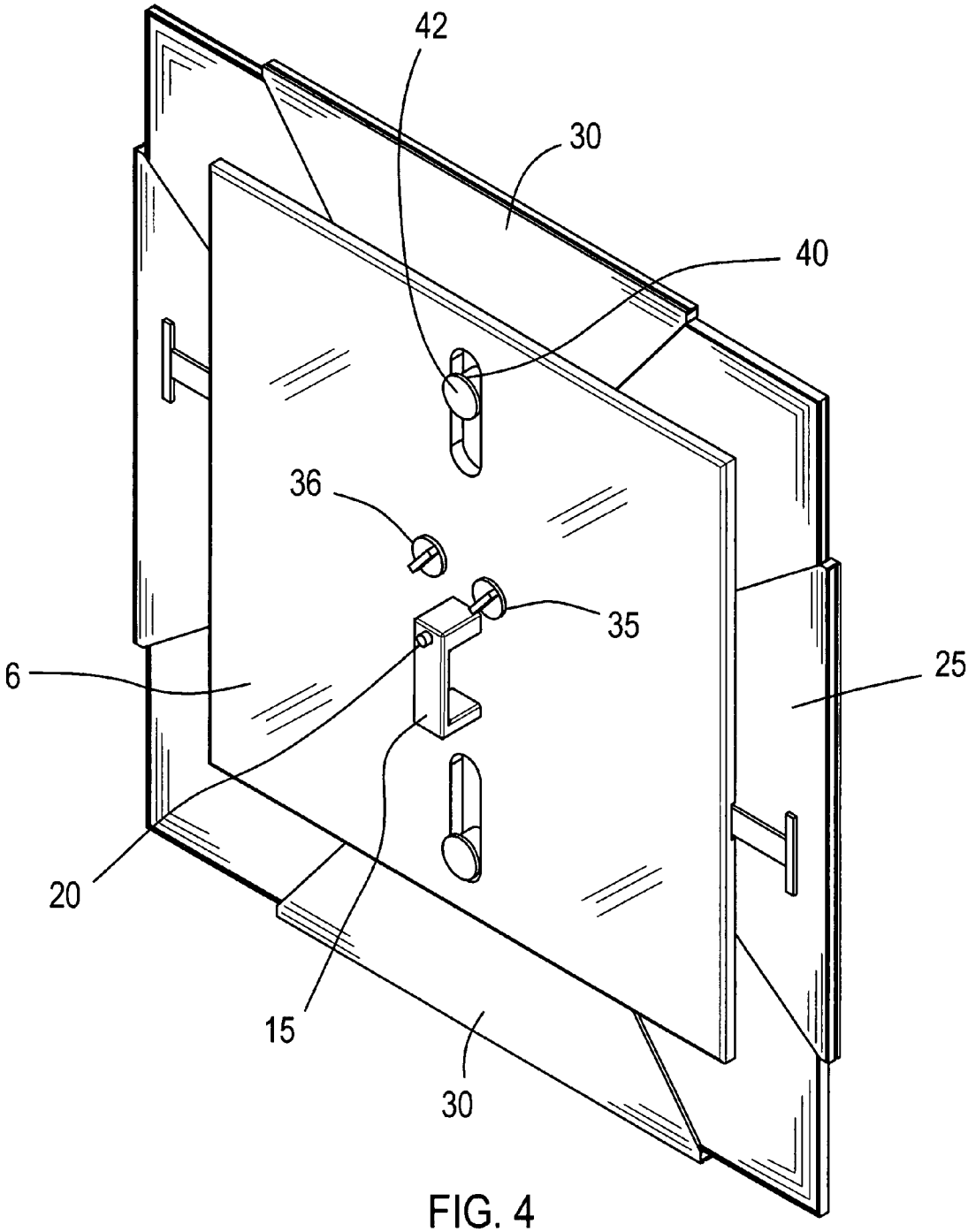
FIG. 4 is an isometric front view of the device without the window structure.
Figure 5:
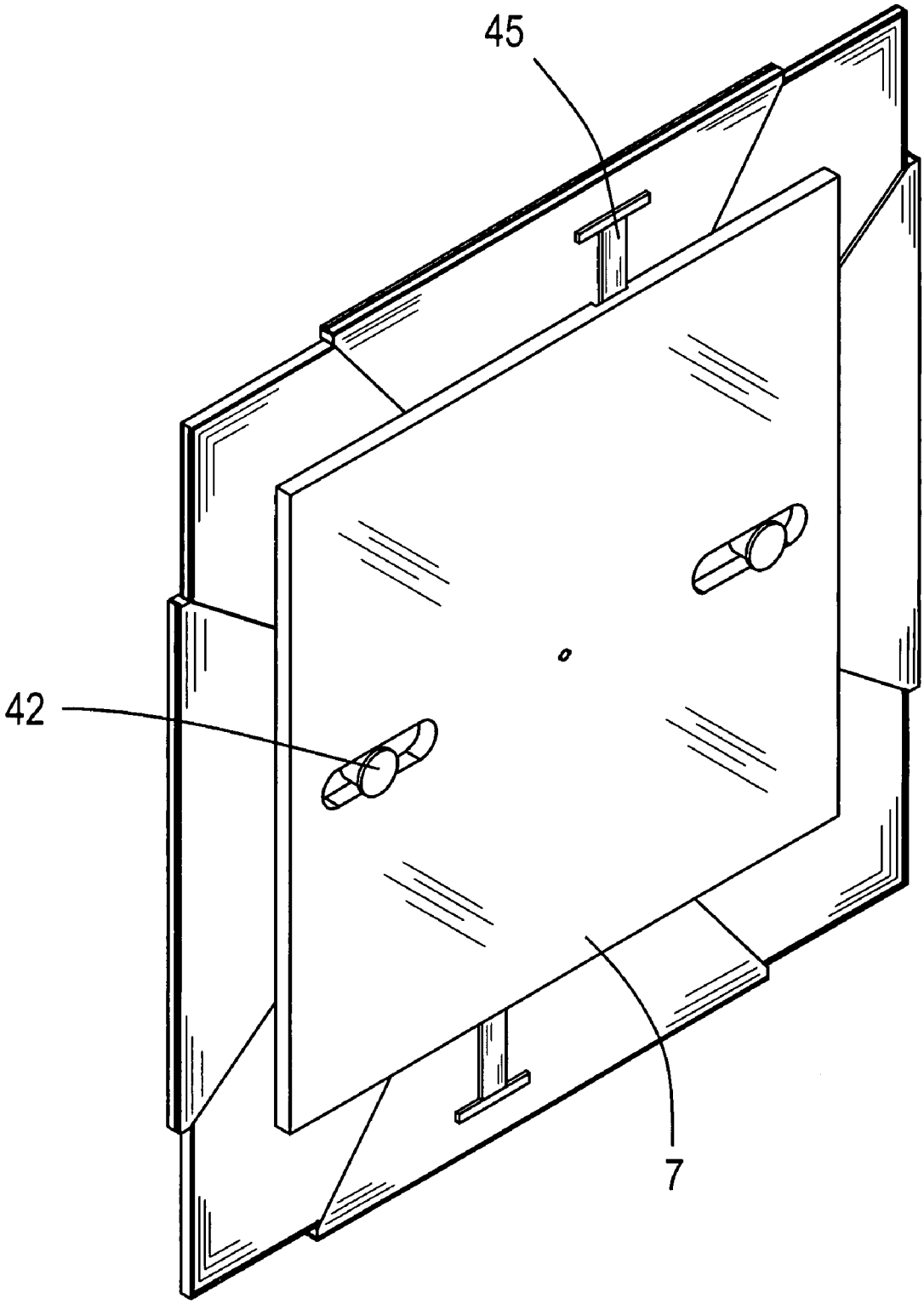
FIG. 5 is an isometric view from the rear of the device.

For purposes of this application, the following numbering will be employed:

5 device
6 front surface
10 building structure
15 handle
20 push button release mechanism
20B first end of the interior release shaft
20C second end of interior release shaft
21 release shaft
25 horizontal panels
30 vertical panels
31 panel seal
35 first exterior turning knob
36 second exterior turning knob

40 eliptical opening
42 connection means for panels
43 corner panels
45 horizontal rack member
46 vertical rack member
50 gear teeth
51 turning knob gear
55 pawl gear
56 second gear
57 first gear
60 pawl
60T pawl teeth
61 adjustment knob shaft
63 release mechanism This device is a window shutter system 5. It will be lightweight, portable and easily installed by an individual with very little physical effect. In order to make it lightweight but yet durable a variety of materials may be used in the construction of this device and possible choices of material may include hard plastic, a metal or wood. No specific material is claimed but the choice of material should be lightweight yet extremely durable.

the device will consist of a front side and a back side. The front side will have a front surface 6. An interior set of gears and associated racks will mate with the gear mechanisms and will be covered by the front and back panels. This is necessary to protect the internal components of this device, particularly the gear mechanisms. On the exterior of the front surface will be a handle 15 and a push button release mechanism 20 located on the handle.

The handle 15 is to allow the person to carry the device and for ease of installation. The push button release mechanism 20 is located on the outside of the handle. The push button release mechanism 20 is comprised of an interior release shaft 21 and a separate connecting shaft with a first end 20B and a second end 20C. Both ends of the interior release shaft 21 are connected to the push button release mechanism 20. Many different types of release mechanism may be used by the preferred embodiment; the release mechanism moves a pawl from front to back which causes the pawl to no longer contact the pawl teeth 60T and allows the horizontal and vertical panels to be retracted.

Figure 6:
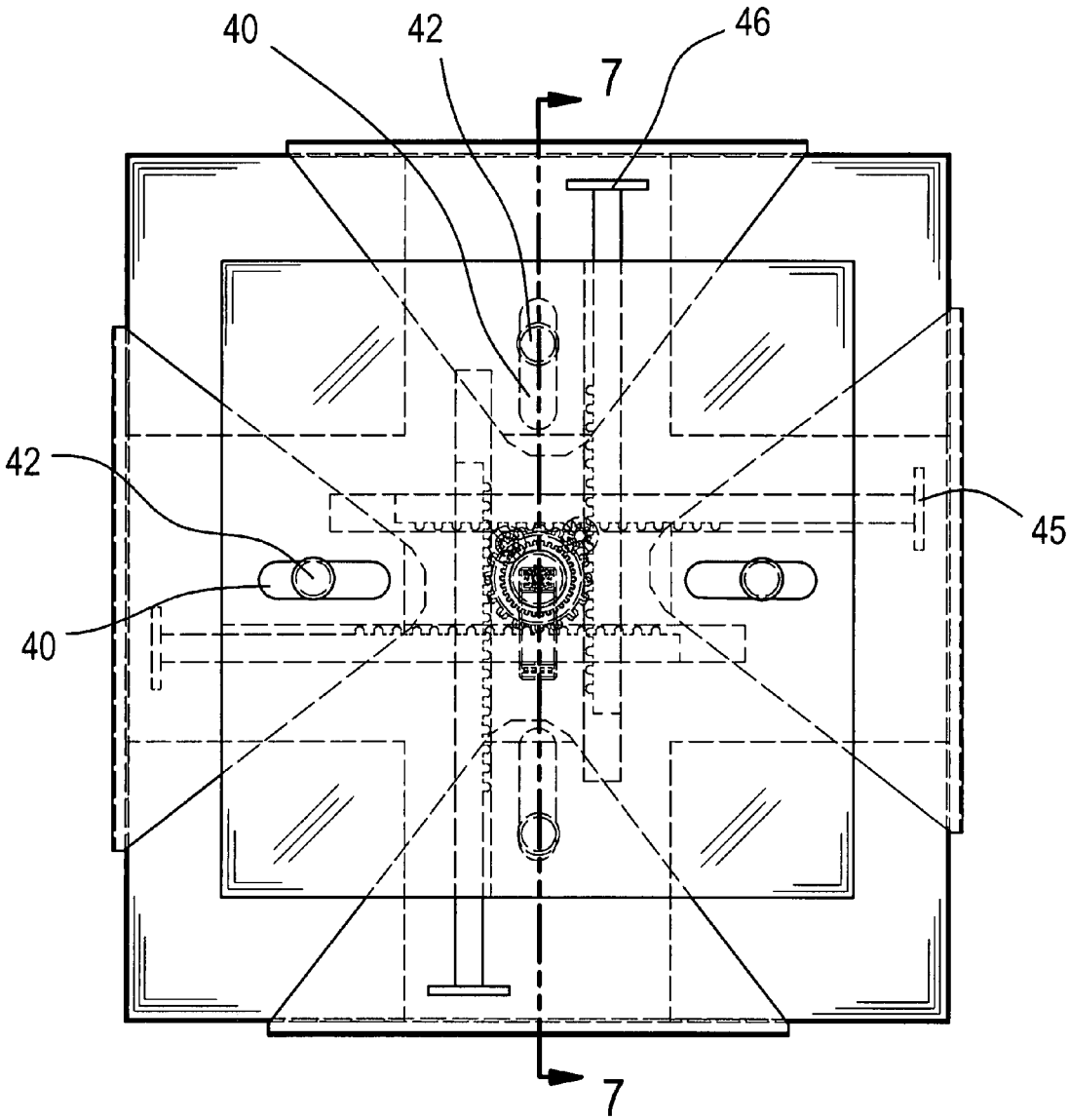
FIG. 6 is a view from the back, showing the internal structure of the device in dashed lines.
Figure 7:
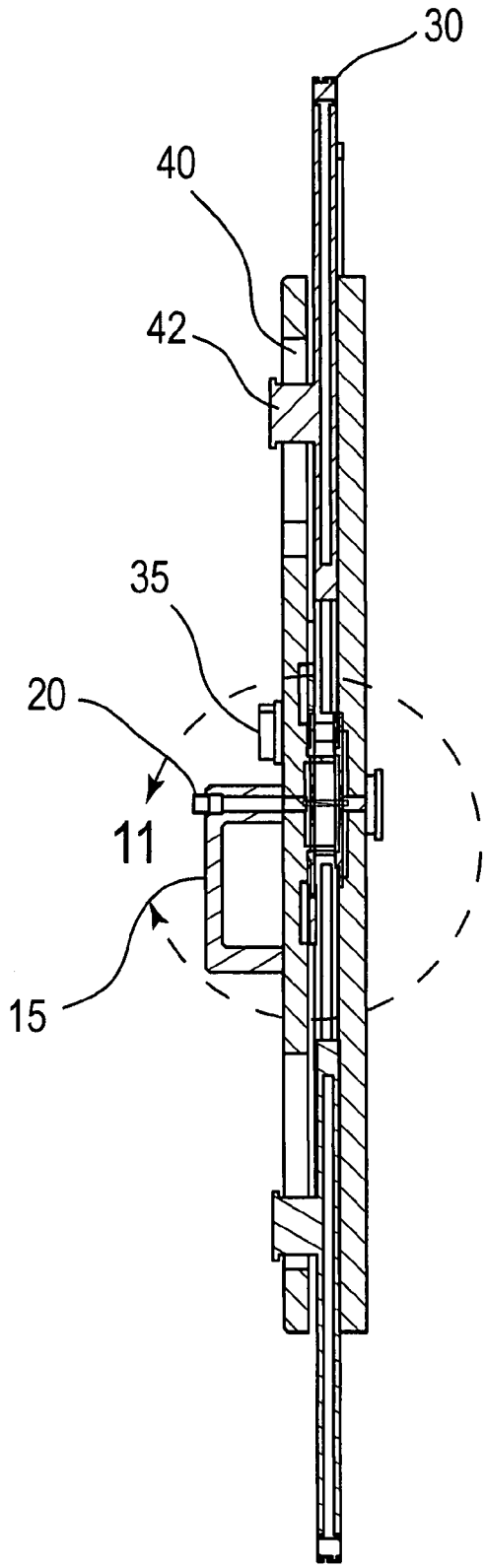
FIG. 7 is a view according to line 7-7 on FIG. 6.
Figure 8:
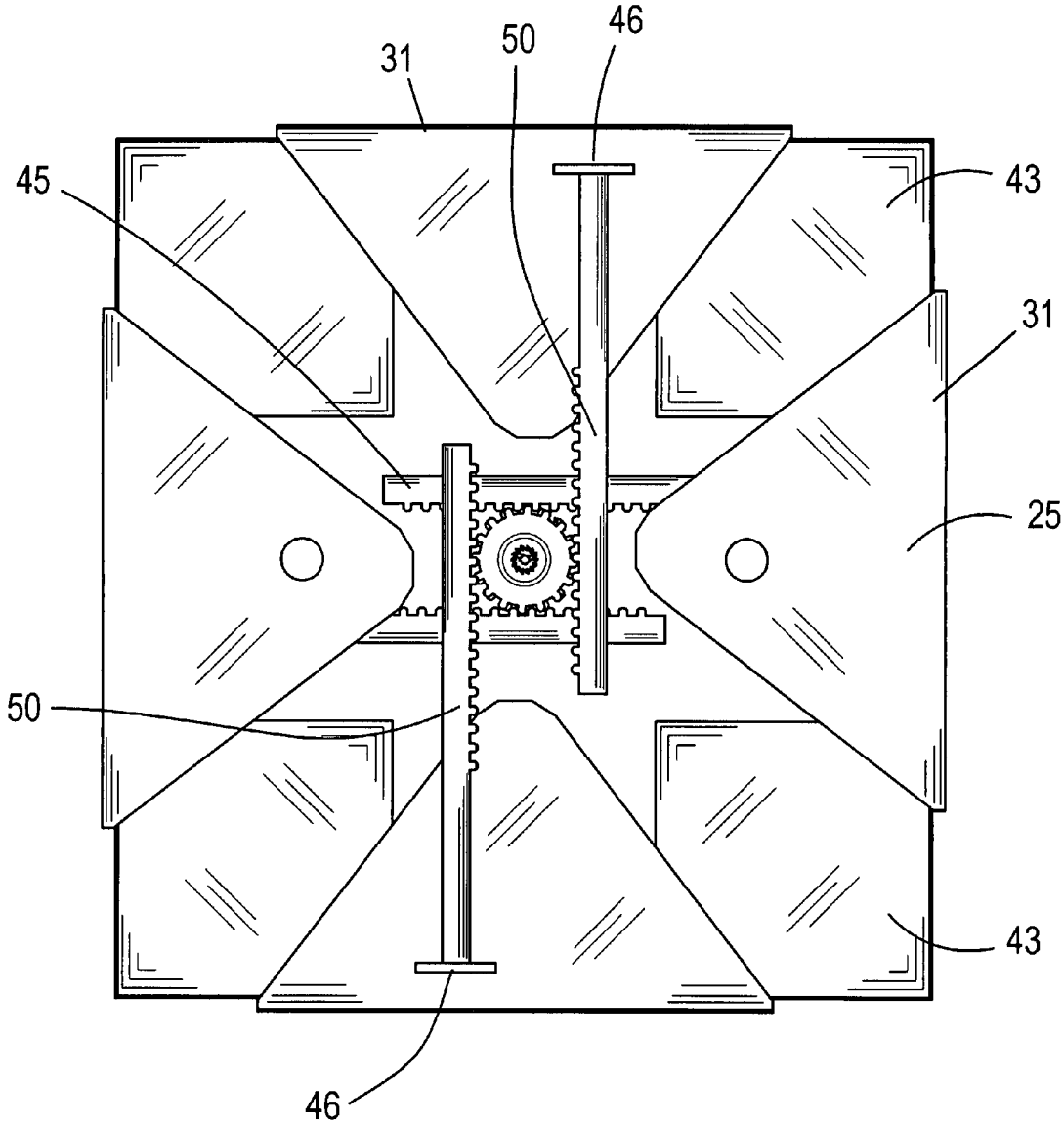
FIG. 8 is a back view of the device, showing the back panel removed.
Figure 9:
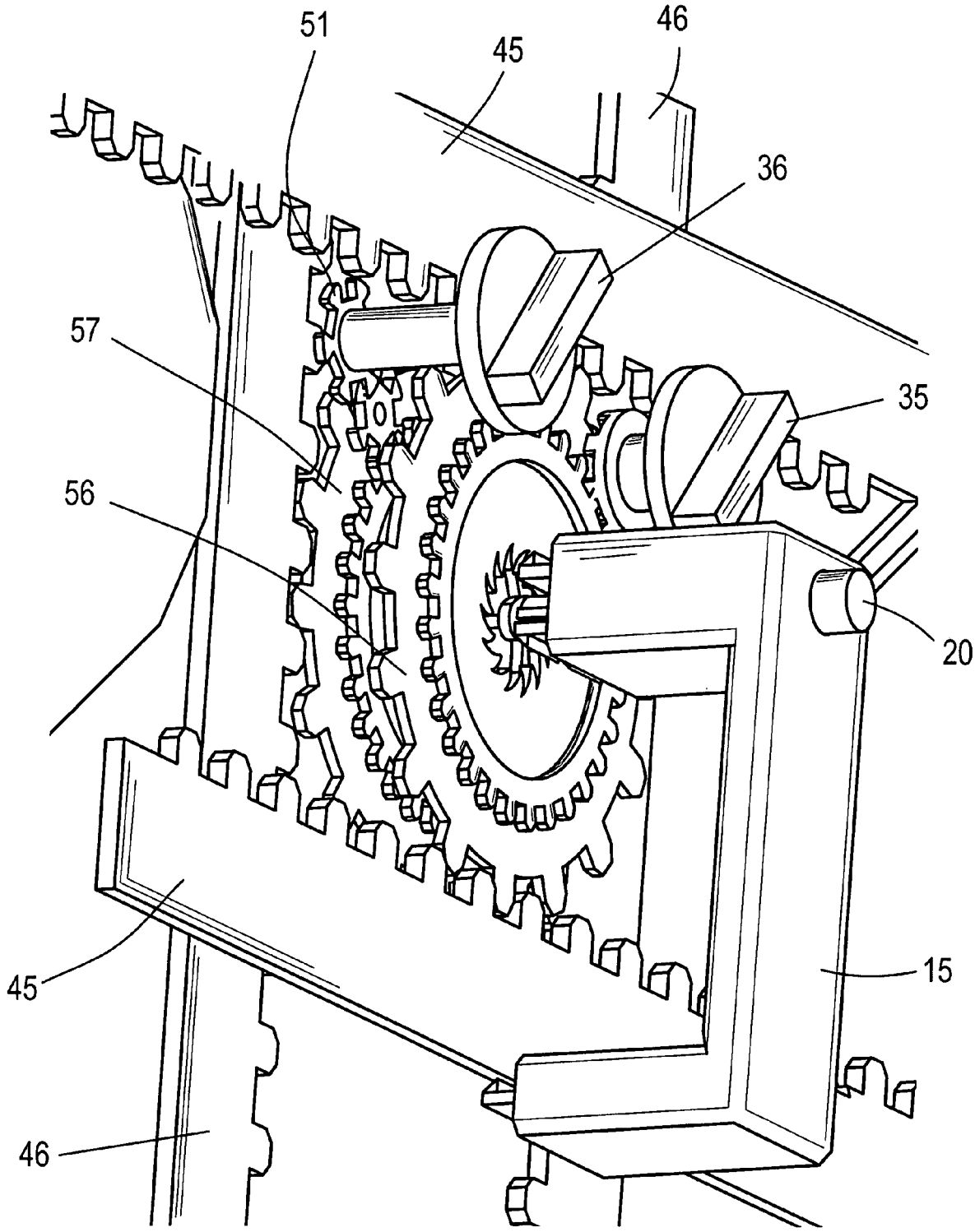
FIG. 9 is an isometric view of the pawl and the gear mechanism.
Figure 10:
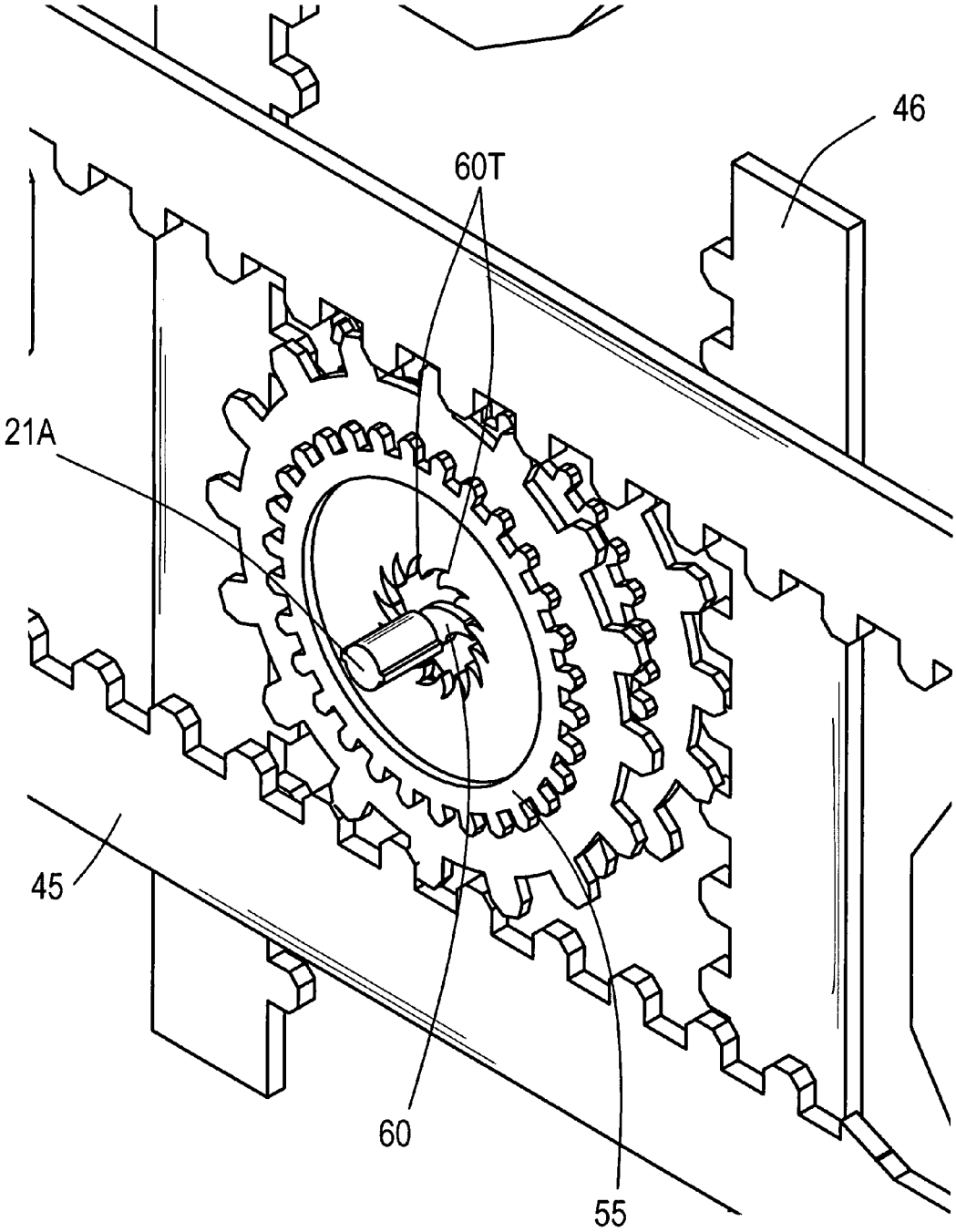
FIG. 10 is an isometric view of the gear mechanism, showing the pawl.
Figure 11:
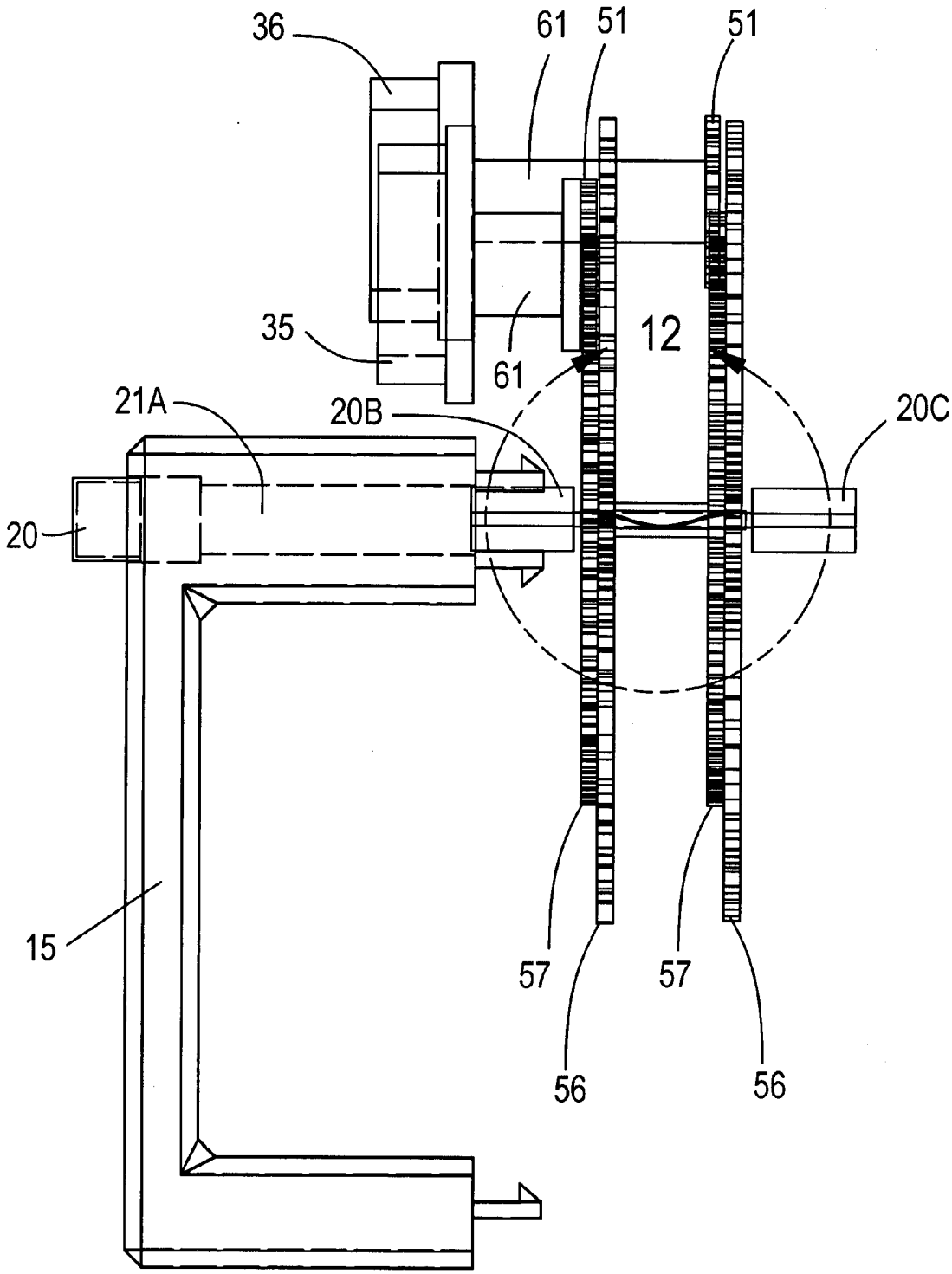
FIG. 11 is a side view of the device, showing the internal gears.
Figure 12:
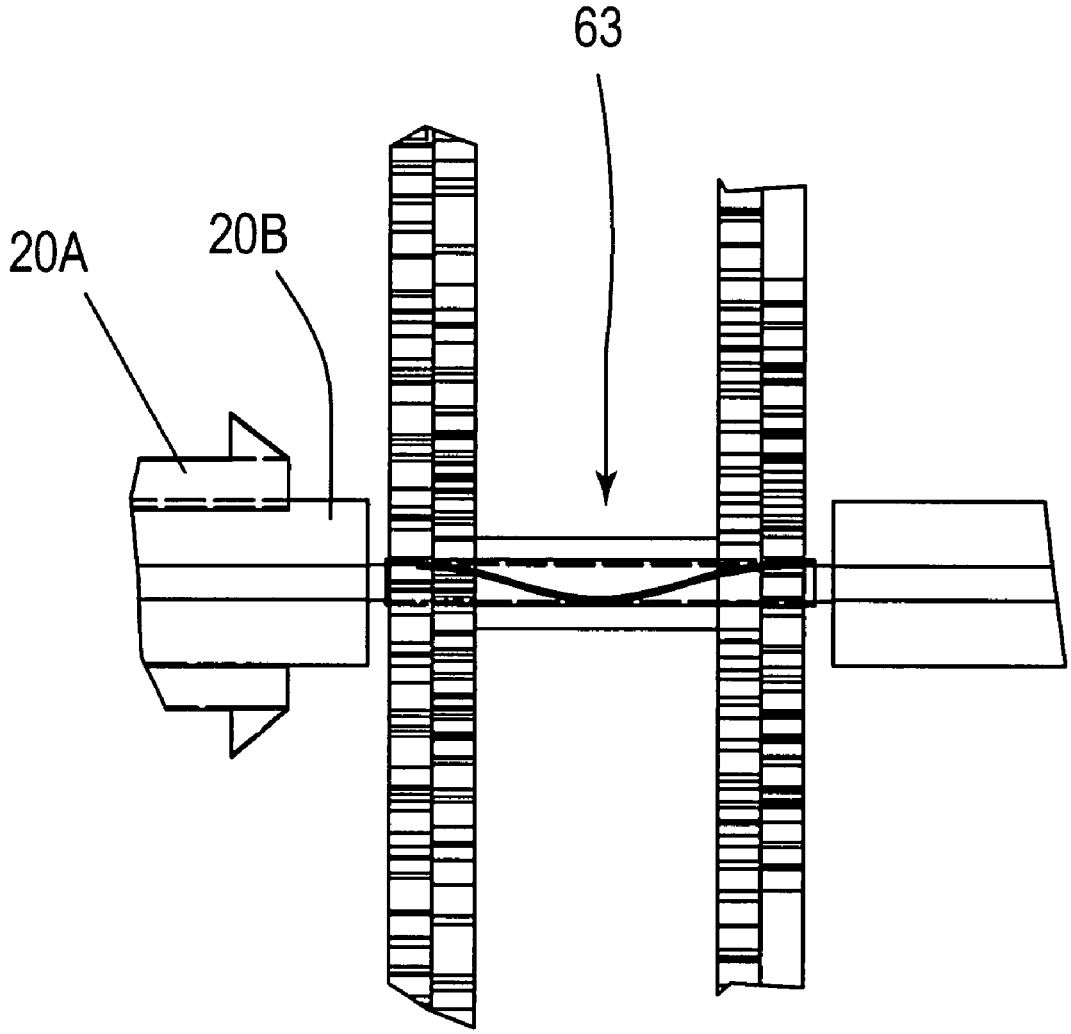
FIG. 12 is an exploded view of item 12 on FIG. 11.
Figure 13:
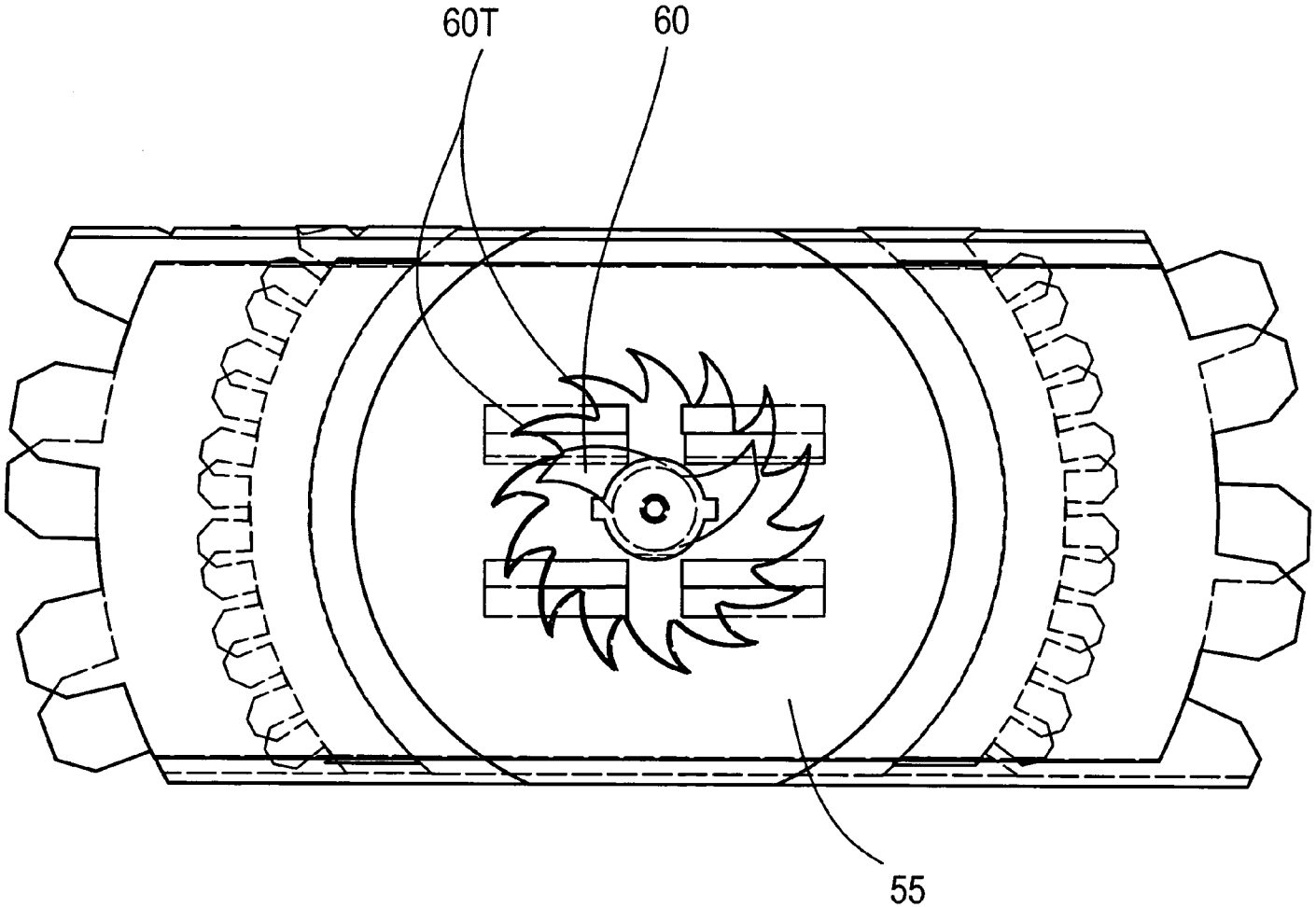
FIG. 13 is a fragmented view of the pawl mechanism.

A set of horizontal panels 25 and vertical panels 30 will also be on the front surface. A series of corner panels 43 are also provided. The corner panels 43 will ride in channels as depicted by the dashed lines on FIG. 6, along the edges of the vertical and horizontal panels respectively. For instance if the vertical panels are deployed initially the corner panel will move in a vertical direction to cover the respective corner or the window frame structure. When the horizontal panels are deployed, the horizontal panels will meet the previously engaged corner panel and completely seal the window.

A seal 31 such as neoprene is placed on the surface of the respective panels to provide appropriate sealing on the exterior of the window frame. The vertical panels will be attached to the device with a means of connection 42 such as a nut and bolt or a rivet and allowed to slide up through a series of elliptical openings 40 on the front surface. The side of the means of connection 42 is flanged so that it will remain within the elliptical opening 40.

A pair of horizontal rack members 45 and a pair of vertical rack members 46 are positioned internally so that as the exterior turning knobs, 35,36 rotate a series of gears 56 move the horizontal and vertical rack member.

The device is placed inside the frame structure surrounding the window, and the exterior turning knobs, first knob 35, and a second knob 36 are turned so that the panels are deployed. The first exterior turning knob 35 will control the position of the horizontal panels and the second exterior turning knob 36 will control the position of the vertical panels. A shaft will connect the first and second exterior turning knobs 35, 36 to a gear member 51; this gear member 51 will mesh with a set of gear teeth 57 that operate the respective horizontal and vertical rack members. As the exterior knobs are rotated the exterior gear member will rotate the gear teeth. A pawl, which is slightly curved and tapered is located within the interior gear member 55. The tapered end of the pawl will fit within the pawl teeth 60T formed by the internal gear teeth.

The release shaft 21 is connected to the pawl 60.

Interior to the device will be a series of gears, including a first gear 57 and a second gear 56 with teeth that position the vertical and horizontal rack members 45, 46. The gear teeth will mesh with the first and second gears 57, 56. When the first and second gears rotate, that movement will deploy the panels with either up-and-down or side-to-side movements depending on which exterior turning knob is being rotated.

Both first gear 57 and second gear 56 will be secured to the pawl gear 55. The pawl 55 will be hollow and will contain a series of curved indentations 60T. The curved indentation 60T will correspond to the shape of the pawl 60. The pawl 60 is connected to a series of shafts, 21, 20B and 20C.

A pawl 60 will be installed, which will mesh with gear teeth inside the inner gear. The inner gear will be attached to a portion of the handle. The pawl itself will lock once it is in lace. To release the device, the release mechanism 20 is depressed and this will move the pawl 60 away from the series of pawl teeth 60T. By this action the rack members are free to move and the device can once again be stored.

The inventor claims:

1. A storm shutter device, which is comprised of a. a front surface, wherein the front surface is of a predetermined dimension; wherein the front surface is solid;

b. a back surface, wherein the back surface is of identical dimension with the front surface, wherein the back surface is solid;

c. a plurality of protective panels, wherein the plurality of protective panels are employed, the plurality of protective panels extend horizontally from the device; the plurality of protective panels extend vertically from the device, a plurality of corner panels are provided, a seal is provided on the edges of the plurality of protective panels;

d. a means of connection for the protective panels;

e. a plurality of gears, wherein the plurality of gears are installed between the front surface and the back surface; the plurality of gears control the movement of the protective panels; wherein a first gear is provided, vertical rack members having gears, said first gear meshes with said gears of the vertical rack members; wherein a second gear is provided, horizontal rack members having gears, said second gear meshes with said gears of the horizontal rack members; a plurality of turning knobs having gears are provided, said turning knob gears have a series of teeth which mate with the first and second gears which control the rack members, the plurality of turning knob gears are connected to a pawl gear, said pawl gear is provided with a plurality of corresponding internal indentations; said plurality of turning knob gears are provided with a plurality of exterior gear teeth;

f. the plurality of horizontal rack members extend from one side to an opposite side;

g. the plurality of vertical rack members extend from one side to an opposite side;

h. said plurality of turning knobs comprised of a first knob and a second knob, a shaft extends from each knob, the first turning knob operates the horizontal rack members and allows the user to adjust the position of the horizontal rack members, the second turning knob operates the vertical rack members and allows the user to adjust the position of the vertical rack members;

i. a handle, wherein the handle is provided on the front surface to transport the device;

j. a push button release, wherein the push button release to provided on the handle, a shaft extends from one end of the push button handle to a pawl release mechanism, said push button release to connected to the pawl release mechanism; and k. the pawl release mechanism is provided to regulate the position of the horizontal and vertical protective panels, the pawl release mechanism moves within the device between a set of pawl teeth, wherein the pawl release mechanism is slightly curved and one end of the pawl release mechanism mates with the pawl teeth.

2. The device as described in claim 1 wherein the means of connection is a river.

3. The device as described in claim 1 wherein the means of connection is a nut and bolt.

4. The device as described in claim 1 wherein the seal material is neoprene.

* * * * *